US008689752B2

(12) United States Patent
Shimazaki et al.

(10) Patent No.: US 8,689,752 B2
(45) Date of Patent: Apr. 8, 2014

(54) VERTICAL-TYPE AIR-COOLED OHV ENGINE

(71) Applicant: Honda Motor Co., Ltd., Tokyo (JP)

(72) Inventors: Yasushi Shimazaki, Wako (JP); Takeshi Maeda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/687,145

(22) Filed: Nov. 28, 2012

(65) Prior Publication Data

US 2013/0133597 A1 May 30, 2013

(30) Foreign Application Priority Data

Nov. 30, 2011 (JP) ..... 2011-262326

(51) Int. Cl.
*F01L 1/18* (2006.01)
*F01L 1/053* (2006.01)

(52) U.S. Cl.
CPC ..... *F01L 1/185* (2013.01); *F01L 1/182* (2013.01); *F01L 1/053* (2013.01)
USPC ..... 123/90.39; 123/90.16; 123/90.27

(58) Field of Classification Search
USPC ..... 123/90.41, 90.16, 90.27, 90.39
See application file for complete search history.

(56) References Cited

U.S. PATENT DOCUMENTS 6,021,766 A * 2/2000 Maeda et al. ..... 123/573

FOREIGN PATENT DOCUMENTS

JP 59-070838 4/1984

* cited by examiner

*Primary Examiner* — Ching Chang
(74) *Attorney, Agent, or Firm* — Rankin, Hill & Clark LLP

(57) ABSTRACT

A vertical-type air-cooled OHV engine includes a valve operating system and has a shroud guiding cooling air, which is generated by a cooling fan driven by a crankshaft such that the cooling air flows in an up-down direction with respect to a cylinder head. Intake and exhaust valves are arranged respectively on opposite sides of a vertical plane that is parallel to an axis of the crankshaft and that includes an axis of a cylinder bore. Accordingly, it is possible to provide a vertical-type air-cooled OHV engine capable of evenly cooling both of intake and exhaust valves without changing a route of cooling air.

4 Claims, 4 Drawing Sheets

VERTICAL-TYPE AIR-COOLED OHV ENGINE

BACKGROUND OF THE INVENTION

1. Field of the Invention

The present invention generally relates to an improvement of a vertical-type air-cooled OHV engine in which a valve operating system is configured to drive intake and exhaust valves provided in a cylinder head to open and close and, more particularly, toward such an engine having a more even cooling of the intake and exhaust valves.

2. Description of the Related Art

Vertical-type air-cooled OHV engine are known, as disclosed in Japanese Patent Application Laid-open No. 59-70838.

In such a vertical-type air-cooled OHV engine, horizontally arranging a cylinder head and a cylinder block continuous with a crankcase makes it possible to achieve a low overall height, thereby achieving a low center of gravity. Accordingly, such an engine is useful as a general purpose engine which serves as a power source for a lawn mower and other various work machines.

However, in a conventional vertical-type air-cooled OHV engine, a cooling fan is attached to an upper end portion of a crankshaft and cooling air generated by the cooling fan flows downward from an upper face side of the cylinder head, which is on the same side as the cooling fan. However, since intake and exhaust valves are vertically arranged side by side in the cylinder head, one of the intake and exhaust valves that is closer to the upper face of the cylinder head against which the cooling air strongly blows is cooled well, but the cooling performance of the other one of the intake and exhaust valves located on a lower side deteriorates.

SUMMARY OF THE INVENTION

The present invention has been made in consideration of the circumstances described above and is directed toward providing a vertical-type air-cooled OHV engine capable of evenly cooling the intake and exhaust valves without changing a route of cooling air.

According to one feature of the present invention, a vertical-type air-cooled OHV engine, which has a valve operating system configured to drive intake and exhaust valves provided in a cylinder head to open and close, includes a camshaft, intake and exhaust push rods, intake and exhaust rocker arms, and a cooling fan. The camshaft is arranged parallel to a crankshaft supported by a crankcase in a vertical attitude so as to be rotationally driven by the crankshaft. The intake and exhaust pushrods are disposed on one side in a cylinder block and the cylinder head and are driven to be lifted and lowered by the camshaft. The intake and exhaust rocker arms are pivotally supported by the cylinder head to open and close the intake and exhaust valves in conjunction with the lifting and lowering of the intake and exhaust pushrods, respectively. The cooling fan is driven by and attached to the crankshaft. The vertical-type air-cooled OHV engine further includes a shroud guiding cooling air, which is generated by the cooling fan, such that the cooling air flows in an up-down direction with respect to the cylinder head. The intake and exhaust valves are arranged respectively on opposite sides of a vertical plane that is parallel to an axis of the crankshaft and that includes an axis of a cylinder bore of the cylinder block.

Therefore, the intake and exhaust valves are substantially equally affected by the heat radiation from an upper face or a lower face of the cylinder head against which the cooling air strongly blows. Accordingly, cooling of the intake valve and cooling of the exhaust valve are effectively facilitated and the resulting improvement in intake and exhaust efficiency can both improve in engine output and reduction in emissions.

According to another feature of the present invention, a surface of the cylinder head directly facing a flow of the cooling air is formed such that distances from the surface to the respective intake and exhaust valves are substantially equal to each other. Therefore, the intake and exhaust valves are cooled from the surface side of the cylinder head under more even conditions. Accordingly, cooling effects of the intake and exhaust valves can be improved.

According to a further feature of the present invention, the cylinder head is provided with an air passage hole penetrating the cylinder head in the up-down direction and passing or extending between the intake and exhaust valves. Therefore, some of the cooling air flowing to the cylinder head facilitates heat radiation from a peripheral wall of the air passage hole provided between the intake and exhaust valves while passing through the air passage hole, and thereby facilitates cooling of the intake and exhaust valves located close to the air passage hole.

According to another feature of the present invention, the intake and exhaust rocker arms are formed to have different lengths depending on a distance between the intake pushrod and the intake valve and a distance between the exhaust pushrod and the exhaust valve. A longer one of the rocker arms is bent such that a center portion thereof, which is pivotally supported by the cylinder head, is offset outward from opposite end portions thereof. An included angle, which is provided between the intake and exhaust valves is such that a distance between the intake and exhaust valves becomes greater toward valve stem ends thereof. The included angle can be easily provided between the intake and exhaust valves while interference between the exhaust rocker arm and the intake valve is avoided. A combustion chamber can thus be formed to be a pent-roof combustion chamber capable of improving combustion of an air-fuel mixture.

These and further features of the invention will be clear from detailed descriptions of the preferred embodiment, which will be provided below with reference to the attached drawings.

DESCRIPTION OF THE PREFERRED EMBODIMENT

An embodiment of the invention is described below with reference to the attached drawings.

Figure 1:
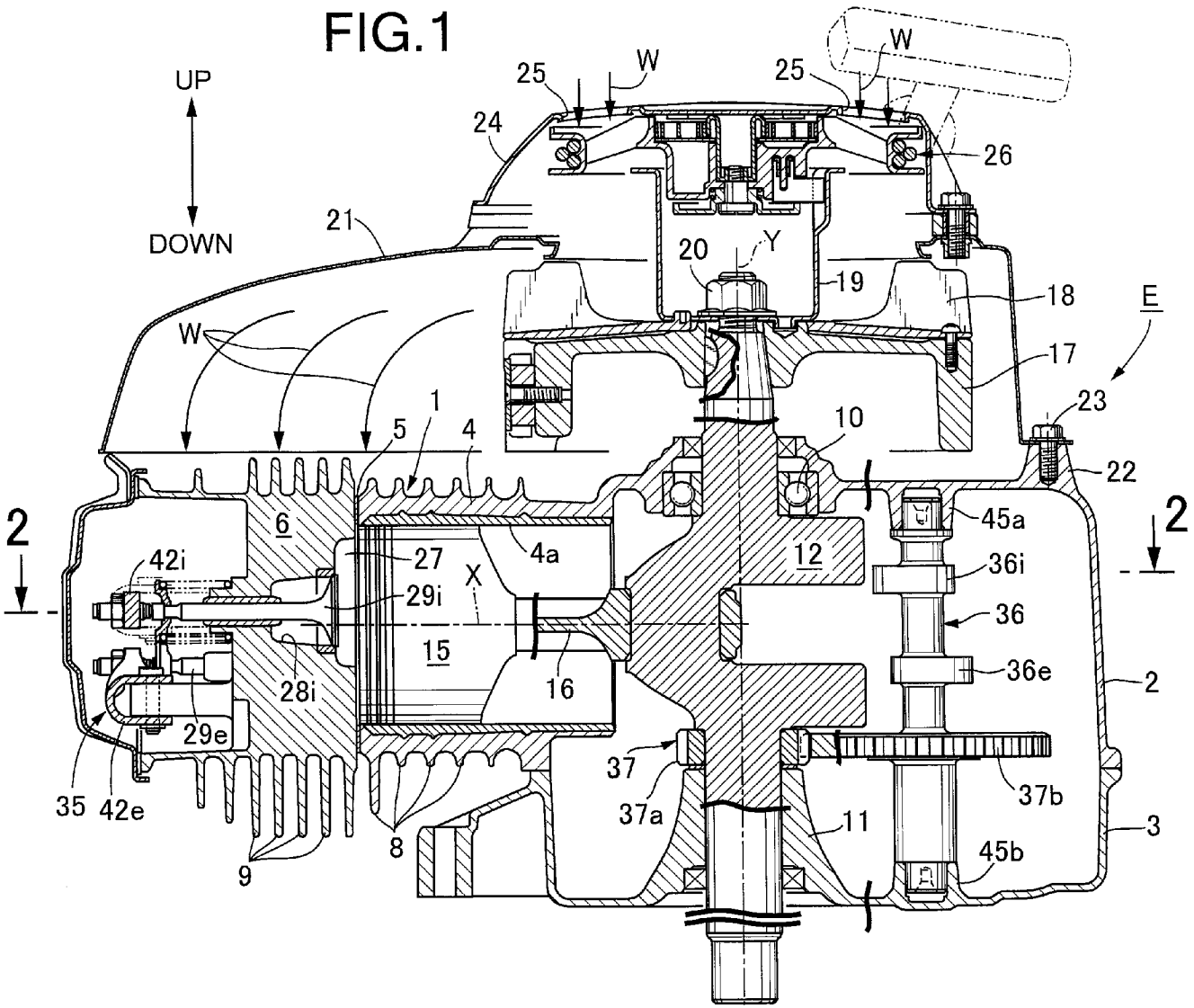
FIG. 1 is a longitudinal sectional plan view of a vertical-type air-cooled OHV engine according to the present invention.

At first, referring to FIG. 1, an engine main body 1 of a vertical-type air-cooled OHV engine (hereafter, simply referred to as engine) E includes: a crankcase 2; an oil pan 3 joined to an open lower end surface of the crankcase 2; a cylinder block 4 integrally connected to one side of the crankcase 2 and disposed horizontally; and a cylinder head 6 joined to an end surface of the cylinder block 4 via a gasket 5. The cylinder block 4 and the cylinder head 6 are connected to each other by multiple bolts 7 (see FIG. 3). Radiation fins 8 are formed on an outer periphery of the cylinder block 4 and radiation fins 9 are formed on an outer periphery of the cylinder head 6.

A ball bearing 10 is installed in the crankcase 2 and a bearing boss 11 is formed integrally with the oil pan 3. Both of upper and lower end portions of a crankshaft 12 in a vertical attitude are rotatably supported by the ball bearing 10 and the bearing boss 11, respectively.

A piston 15 is slidably fitted to a horizontal cylinder bore 4*a* formed in the cylinder block 4. The piston 15 is connected to the crankshaft 12 via a connecting rod 16.

A flywheel 17 is connected to an upper end portion of the crankshaft 12 by a key. The flywheel 17, a centrifugal cooling fan 18 placed on an upper end surface of the flywheel 17, and a starter cylinder 19 placed on an upper end surface of a center portion of the cooling fan 18 are fixedly attached to each other by a nut 20. Accordingly, the cooling fan 18 is configured to be rotationally driven by the crankshaft 12 together with the flywheel 17.

In an upper face of the engine main body 1, a peripheral edge portion of a shroud 21 surrounding the cooling fan 18 and extending toward the cylinder head 6 is fixedly attached to multiple bosses 22 (FIG. 1 shows only one of the bosses 22) protruding from the upper face of the engine main body 1, by using bolts 23. A louver 24 bulging upward is connected to a portion of the shroud 21 that faces the cooling fan 18. A recoil starter 26 capable of cranking the crankshaft 12 in cooperation with the starter cylinder 19 is attached to an inner wall of the louver 24.

The louver 24 has multiple cooling air introduction holes 25. Moreover, the shroud 21 is configured to guide cooling air W introduced from the cooling air introduction holes 25 by the rotation of the cooling fan 18 in such a way that the cooling air W flows from above the cylinder head 6 to below the cylinder head 6.

Figure 2:
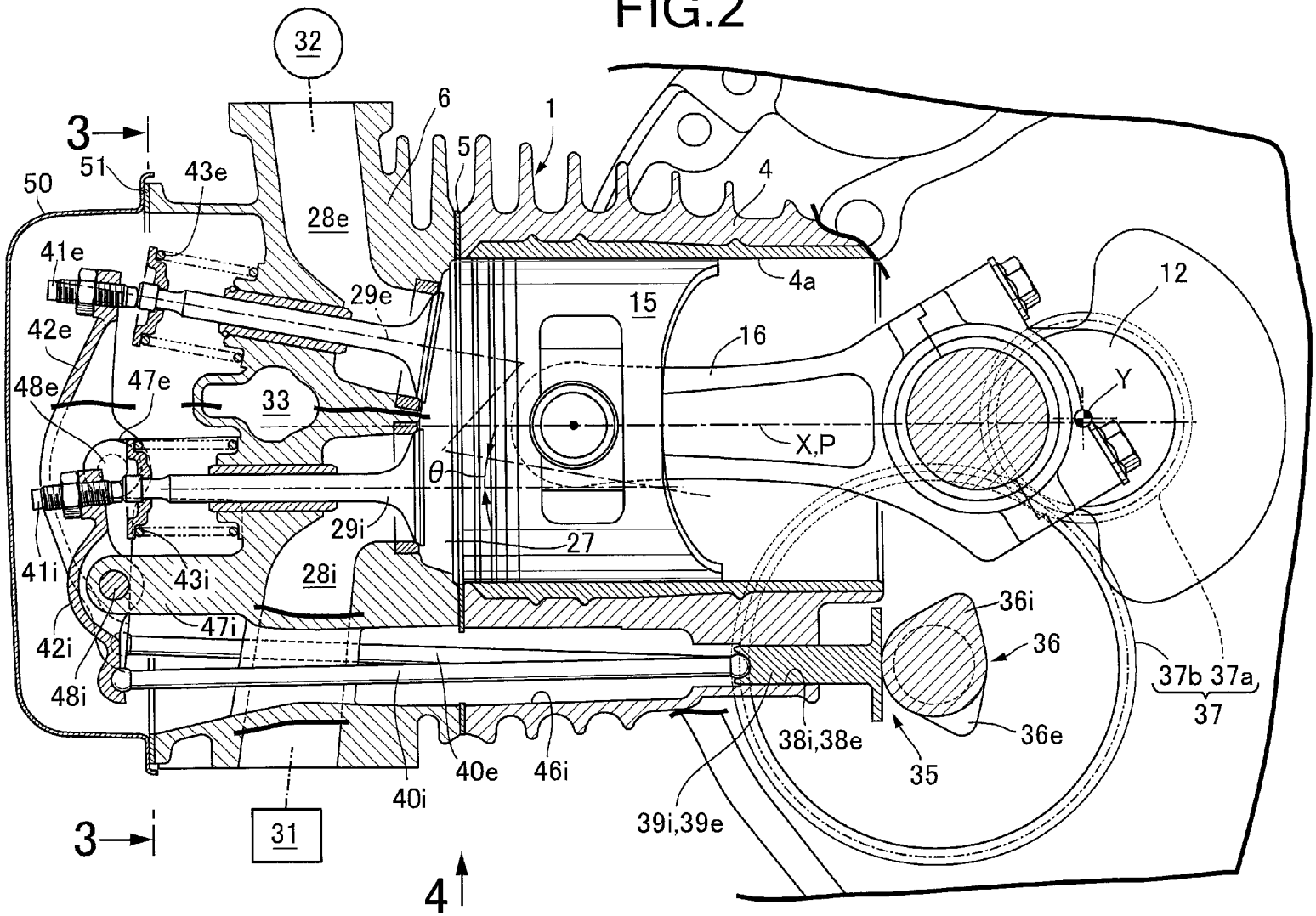
FIG. 2 is an enlarged sectional view taken along a line 2-2 in FIG. 1.
Figure 3:
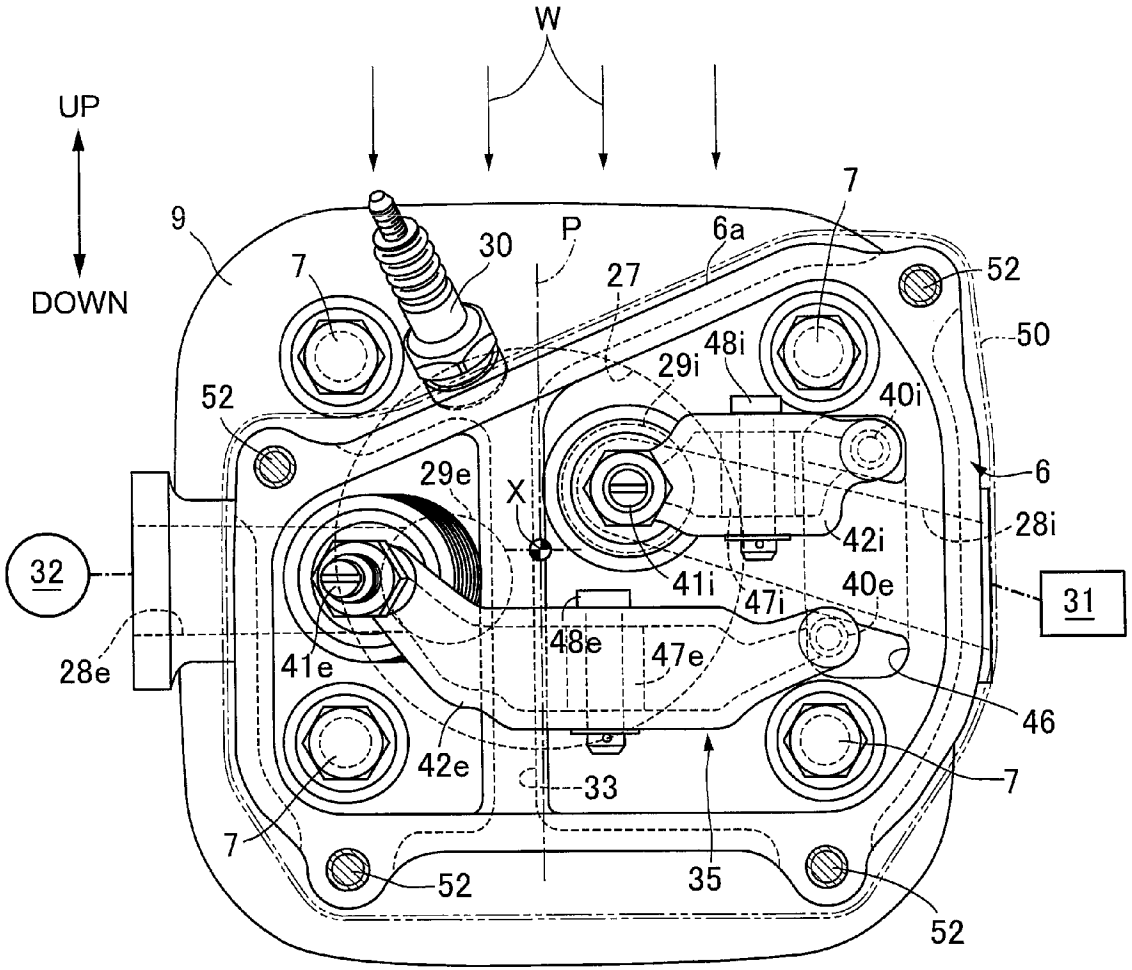
FIG. 3 is a sectional view taken along a line 3-3 in FIG. 2.
Figure 4:
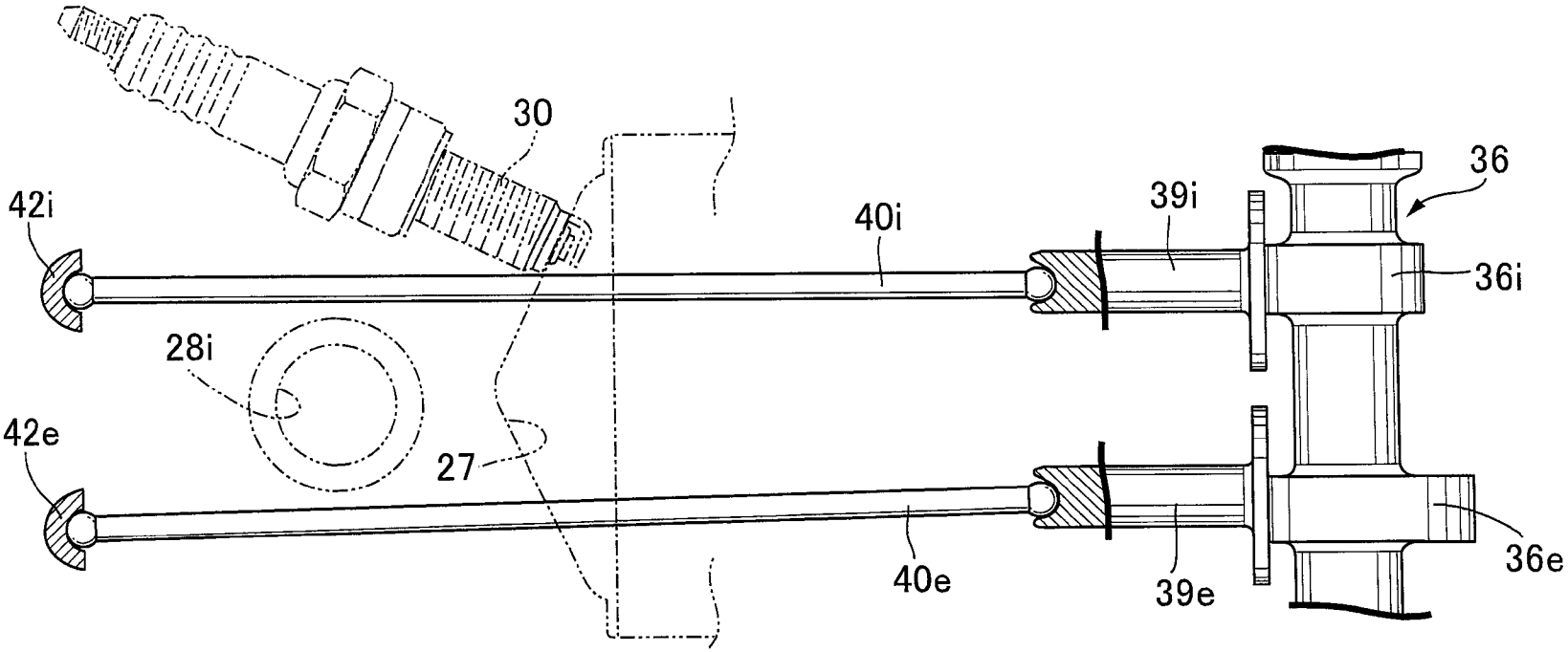
FIG. 4 is a bottom view of a valve operating system seen from a direction of an arrow 4 in FIG. 2.

As shown in FIGS. 2 to 4, a combustion chamber 27, which a top face of the piston 15 faces, as well as intake and exhaust ports 28*i* and 28*e*, which are opened to the combustion chamber 27, are formed in the cylinder head 6. Moreover, intake and exhaust valves 29*i* and 29*e*, which open and close opening end portions of the intake and exhaust ports 28*i* and 28*e* to the combustion chamber 27, are attached to the cylinder head 6. Furthermore, an ignition plug 30 having an electrode facing the combustion chamber 27 is screwed to the cylinder head 6. A carburetor 31 and a muffler 32 are connected respectively to the intake and exhaust ports 28*i* and 28*e*.

As clearly shown in FIGS. 2 and 3, the intake and exhaust valves 29*i* and 29*e* are disposed respectively on opposite sides of a vertical plane P, which is parallel to an axis Y of the crankshaft 12 and includes an axis X of the cylinder bore 4*a*. Moreover, the intake valve 29*i* is arranged parallel to the axis X of the cylinder bore 4*a* and the exhaust valve 29*e* is arranged such that the distance between the exhaust valve 29*e* and the intake valve 29*i* becomes greater toward valve stem ends thereof. Specifically, an included angle θ is provided between the intake and exhaust valves 29*i* and 29*e* and the combustion chamber 27 is thereby formed to be a pent-roof combustion chamber capable of improving combustion of an air-fuel mixture.

In addition, as shown in FIG. 3, the exhaust valve 29*e* is disposed at a position slightly lower than the intake valve 29*i* and an upper face 6*a* of the cylinder head 6, except for joining portions with the cylinder block 4, is formed to be an inclined surface, such that the distances from the upper face 6*a* to the respective intake valve 29*i* and exhaust valve 29*e* are substantially equal to each other.

Moreover, the cylinder head 6 is provided with an air passage hole 33 penetrating the cylinder head 6 in an up-down direction so as to pass or extend between the intake and exhaust valves 29*i* and 29*e*. The ignition plug 30 is disposed near an inlet port of the air passage hole 33.

A valve operating system 35 that drives the intake and exhaust valves 29*i* and 29*e* to open and close is configured as follows. The valve operating system 35 includes a camshaft 36, a timing gear train 37, intake and exhaust tappets 39*i* and 39*e*, intake and exhaust pushrods 40*i* and 40*e*, intake and exhaust rocker arms 42*i* and 42*e*, and intake and exhaust valve springs 43*i* and 43*e*. The camshaft 36 has intake and exhaust cams 36*i* and 36*e* and is disposed parallel to the crankshaft 12. The timing gear train 37 connects the crankshaft 12 and the camshaft 36 to each other. The intake and exhaust tappets 39*i* and 39*e* are slidably supported respectively by guide holes 38*i* and 38*e* formed on one side in a lateral direction in the cylinder block 4 and are in contact with the intake and exhaust cams 36*i* and 36*e*, respectively, so as to be slidable thereon. The intake and exhaust pushrods 40*i* and 40*e* each have one end engaging with a tip end of a corresponding one of the intake and exhaust tappets 39*i* and 39*e* with a ball joint. The intake and exhaust rocker arms 42*i* and 42*e* each have one end engaging with the other end of a corresponding one of the intake and exhaust pushrods 40*i* and 40*e* with a ball joint, and each have the other end brought into contact with a head portion of a corresponding one of the intake and exhaust valves 29*i* and 29*e* via a corresponding one of valve stem end distance adjustment bolts 41*i* and 41*e*. The intake and exhaust valve springs 43*i* and 43*e*, which are fitted respectively to the intake and exhaust valves 29*i* and 29*e*, bias the valves 29*i* and 29*e*, respectively, in a closing direction.

The camshaft 36 is rotatably supported by bearing bosses 45*a*, 45*b* formed in the crankcase 2 and the oil pan 3, respectively. The timing gear train 37 includes a drive gear 37*a* and a follower gear 37*b*. The drive gear 37*a* is fixed to the crankshaft 12 to be adjacent to an inner end of the bearing boss 11 of the oil pan 3. The follower gear 37*b* is formed integrally with the camshaft 36 and is driven at a reduction gear ratio of 1/2 to the drive gear 37*a*.

A pushrod passage 46 formed to communicate with the guide holes 38*i* and 38*e* is formed on the one side in the lateral direction in the cylinder block 4 and the cylinder head 6. The intake and exhaust pushrods 40*i* and 40*e* are housed in the pushrod passage 46. In this case, the intake and exhaust pushrods 40*i* and 40*e* are arranged with the intake port 28*i* therebetween (see FIG. 4).

As clearly shown in FIGS. 2 and 3, intake and exhaust support columns 47*i* and 47*e*, protruding more outward than the valve stem ends of the intake and exhaust valves 29*i* and 29*e*, are formed integrally with the cylinder head 6. The intake support column 47*i* is disposed at an intermediate point between the intake pushrod 40*i* and the intake valve 29*i* while the exhaust support column 47*e* is disposed at an intermediate point between the exhaust pushrod 40*e* and the exhaust valve 29*e*. A center portion of the intake rocker arm 42*i* is swingably supported by the intake support column 47*i* via an intake rocker shaft 48*i* while a center portion of the exhaust rocker arm 42*e* is swingably supported by the exhaust support column 47*e* via an exhaust rocker shaft 48*e*. The intake rocker shaft 48*i* and the exhaust rocker shaft 48*e* are arranged parallel to the crankshaft 12.

Incidentally, as described above, the intake and exhaust valves 29*i* and 29*e* are disposed on opposite sides of the vertical plane P passing through the axis Y of the crankshaft 12 and the axis X of the cylinder bore 4*a*. Moreover, the included angle θ is provided between the intake and exhaust valves 29*i* and 29*e*, as shown in FIG. 2. Accordingly, the distance between the intake valve 29*i* and the intake pushrod 40*i* is relatively short and the distance between the exhaust valve 29*e* and the exhaust pushrod 40*e* is relatively long. Hence, the intake rocker arm 42*i* connecting the intake pushrod 40*i* and the intake valve 29*i* to each other is formed to be relatively short while the exhaust rocker arm 42*e* connecting the exhaust pushrod 40*e* and the exhaust valve 29*e* to each other is formed to be relatively long. The exhaust rocker shaft 48*e* supporting the relatively long exhaust rocker arm 42*e* is offset to be disposed on an outer side of the exhaust valve 29*e* to avoid interference with the intake valve 29*i*. In relation with this, the exhaust rocker arm 42*e* is formed to be bent such that the center portion thereof supported by the exhaust rocker shaft 48*e* is offset to a side opposite to the intake valve 29*i* and, from opposite end portions thereof, connected respectively to the exhaust pushrod 40*e* and the exhaust valve 29*e*, as shown best in FIG. 3. As such, the bent center portion of the exhaust rocker arm 42*e* is generally offset from an imaginary line (not shown) interconnecting the opposite ends of the exhaust rocker arm 42*e*.

A head cover 50 covering the valve operating system 35 on the cylinder head 6 is joined to the cylinder head 6 by using multiple bolts 52 (see FIG. 3) via a sealing member 51.

Next, operations of the embodiment are described.

While the engine E is operating, the camshaft 36 is driven by the crankshaft 12 via the timing gear train 37, and the intake and exhaust cams 36*i* and 36*e* push the intake and exhaust pushrods 40*i* and 40*e* via the intake and exhaust tappets 39*i* and 39*e*. In this case, the intake and exhaust rocker arms 42*i* and 42*e* swing against set loads of the intake and exhaust valve springs 43*i* and 43*e* and open the intake and exhaust valves 29*i* and 29*e*. Moreover, when the intake and exhaust cams 36*i* and 36*e* release the intake and exhaust tappets 39*i* and 39*e*, the intake and exhaust valves 29*i* and 29*e* are closed by the resilient force of the valve spring 43*i* and the resilient force of the valve spring 43*e*.

Meanwhile, the cooling fan 18, which is rotationally driven by the crankshaft 12, takes outside air from the cooling air introduction holes 25 of the louver 24 as cooling air, and compresses and sends the cooling air outward in a radial direction. Then, the cooling air W is guided by the shroud 21 to flow toward the cylinder head 6. The cooling air W flows downward from the upper face 6*a* of the cylinder head 6, which is on the same side as the cooling fan 18, through the periphery of the cylinder head 6 and the air passage hole 33. The cooling air W thus cools the cylinder head 6. At this time, the cooling air W blows strongly against the upper face 6*a* of the cylinder head 6. Accordingly, heat is radiated particularly well from the upper face 6*a*.

Incidentally, the intake and exhaust valves 29*i* and 29*e* are respectively disposed on opposite sides of the vertical plane P, which is parallel to the axis Y of the crankshaft 12 and includes the axis X of the cylinder bore 4*a* of the cylinder block 4. Hence, the intake and exhaust valves 29*i* and 29*e* are substantially equally affected by the heat radiation from the upper face 6*a* of the cylinder head 6. Accordingly, cooling of the intake valve 29*i* and cooling of the exhaust valve 29*e* are both effectively facilitated and improvement in intake and exhaust efficiency can achieve improvement in engine output and reduction in emissions.

Particularly, since the upper face 6*a* of the cylinder head 6, which directly faces the flow of the cooling air W, is formed such that the distances from the upper face 6*a* to the respective intake valve 29*i* and exhaust valve 29*e* are substantially equal to each other, the intake and exhaust valves 29*i* and 29*e* are cooled from the upper face 6*a* side of the cylinder head 6 under more even conditions. Accordingly, cooling effects of the valves 29*i* and 29*e* can be improved.

Moreover, part of the cooling air W flowing to the upper face 6*a* of the cylinder head 6 passes through the air passage hole 33 and thereby facilitates heat radiation from a peripheral wall of the air passage hole 33 provided between the intake and exhaust valves 29*i* and 29*e*. This facilitates cooling of the intake and exhaust valves 29*i* and 29*e* located close to the air passage hole 33. In addition, since the ignition plug 30 is disposed near the inlet port of the air passage hole 33, the ignition plug 30 can also be cooled by the cooling air W flowing through the air passage hole 33. Hence, the durability of the ignition plug 30 can be improved.

Furthermore, the intake rocker arm 42*i* is formed to be relatively short and the exhaust rocker arm 42*e* is formed to be relatively long, depending on the distance between the intake pushrod 40*i* and the intake valve 29*i* and the distance between the exhaust pushrod 40*e* and the exhaust valve 29*e*. This long exhaust rocker arm 42*e* is formed in a bent shape such that the center portion thereof supported by the exhaust rocker shaft 48*e* is offset outward from opposite end portions thereof. This allows the included angle θ to be easily provided between the intake and exhaust valves 29*i* and 29*e* while avoiding interference between the exhaust rocker arm 42*e* and the intake valve 29*i*.

The present invention is not limited to the embodiment described above. Various design changes can be made within the scope not departing from the gist of the present invention. For example, the cooling fan 18 may be attached to a lower end portion of the crankshaft 12 to make the cooling air generated by the cooling fan 18 flow upward from a lower face side of the cylinder head 6. Moreover, in the embodiment described above, it is possible to reverse the arrangement of the intake and exhaust valves 29*i* and 29*e* and also to reverse the arrangement of the members of the intake system and the members of the exhaust system in the valve operating system 35.

What is claimed is:

1. A vertical-type air-cooled OHV engine, comprising:

a valve operating system configured to drive intake and exhaust valves provided in a cylinder head to open and close, said valve operating system comprising:

a camshaft arranged parallel to a crankshaft supported by a crankcase in a vertical attitude, said camshaft being rotationally driven by the crankshaft;

intake and exhaust pushrods that are disposed on one side in a cylinder block and the cylinder head relative to an axis of a cylinder bore of the cylinder block, said pushrods being driven to be lifted and lowered by the camshaft; and intake and exhaust rocker arms that are pivotally supported by the cylinder head to open and close the intake and exhaust valves in conjunction with the lifting and lowering of the intake and exhaust pushrods, the vertical-type air-cooled OHV engine further including:

a cooling fan attached to and driven by the crankshaft, a shroud guiding cooling air, generated by the cooling fan, such that the cooling air flows in an up-down direction with respect to the cylinder head, wherein the intake and exhaust valves are arranged respectively on opposite sides of a vertical plane which is parallel to an axis of the crankshaft and which includes the axis of the cylinder bore of the cylinder block, wherein the intake and exhaust rocker arms are formed to have different lengths depending on a distance between the intake pushrod and the intake valve and a distance between the exhaust pushrod and the exhaust valve, a longer one of the rocker arms is formed to be bent such that a center portion thereof pivotally supported by the cylinder head is offset outward from opposite end portions thereof, and an included angle formed between the intake and exhaust valves is such that a distance between the intake and exhaust valves becomes greater toward valve stem ends thereof.

2. The vertical-type air-cooled OHV engine according to claim 1, wherein a surface of the cylinder head directly facing a flow of the cooling air is formed such that a distance from the surface to the intake valve is substantially equal to a distance from the surface to the exhaust valve.

3. The vertical-type air-cooled OHV engine according to claim 2, wherein the cylinder head is provided with an air passage hole penetrating the cylinder head in an up-down direction and extending between the intake and exhaust valves.

4. The vertical-type air-cooled OHV engine according to claim 1, wherein the cylinder head is provided with an air passage hole penetrating the cylinder head in an up-down direction and extending between the intake and exhaust valves.

* * * * *